US005446430A

United States Patent [19]

Yamanaka et al.

[11] Patent Number: 5,446,430

[45] Date of Patent: Aug. 29, 1995

[54] FOLDED STRIP LINE TYPE DIELECTRIC RESONATOR AND MULTILAYER DIELECTRIC FILTER USING THE SAME

[75] Inventors: Hideki Yamanaka, Ube; Teruto Sugano; Masanobu Mitarai, both of Onoda, all of Japan

[73] Assignee: Fuji Electrochemical Co., Ltd., Tokyo, Japan

[21] Appl. No.: 87,744

[22] PCT Filed: Oct. 22, 1992

[86] PCT No.: PCT/JP92/01377

§ 371 Date: Jul. 12, 1993

§ 102(e) Date: Jul. 12, 1993

[87] PCT Pub. No.: WO93/10570

PCT Pub. Date: May 27, 1993

[30] Foreign Application Priority Data

| | | | |
|---|---|---|---|
| Nov. 12, 1991 | [JP] | Japan | 3-323759 |
| Nov. 28, 1991 | [JP] | Japan | 3-339789 |
| Dec. 10, 1991 | [JP] | Japan | 3-350050 |
| Dec. 21, 1991 | [JP] | Japan | 3-355852 |

[51] Int. Cl.[6] ..... H01P 1/20; H01P 1/203; H01P 7/00

[52] U.S. Cl. ..... 333/202; 333/219; 333/204

[58] Field of Search ..... 333/202, 203, 204, 205, 333/219, 246

[56] References Cited

U.S. PATENT DOCUMENTS 4,812,791 3/1989 Makimoto et al. ..... 333/204 X

FOREIGN PATENT DOCUMENTS

| | | | |
|---|---|---|---|
| 57-204602 | 12/1982 | Japan . | |
| 58-103202 | 6/1983 | Japan . | |
| 60-190002 | 9/1985 | Japan . | |
| 0028201 | 2/1986 | Japan | 333/204 |
| 62-193303 | 8/1987 | Japan . | |
| 0127602 | 5/1988 | Japan | 333/204 |
| 63-127602 | 5/1988 | Japan . | |
| 63-212202 | 9/1988 | Japan . | |
| 0290303 | 11/1990 | Japan | 333/219 |

*Primary Examiner*—Seungsook Ham

*Attorney, Agent, or Firm*—Keck, Mahin & Cate

[57] ABSTRACT

A dielectric resonator of a folded strip line type structure in which an electrode is formed on the outer circumferential portion of a cutout-carrying U-shaped dielectric substrate exclusive of the upper and lower surfaces thereof and either one of two end surfaces at the opened portion of the cutout. An island electrode formed in the vicinity of a non-electrode-carrying end surface out of the two end surfaces at the opened portion of the cutout is used as an input-output coupling electrode. The inner wall surface of the cutout can be formed wavily, and a separate dielectric member can be fitted into the cutout.

17 Claims, 11 Drawing Sheets

FOLDED STRIP LINE TYPE DIELECTRIC RESONATOR AND MULTILAYER DIELECTRIC FILTER USING THE SAME

BACKGROUND OF THE INVENTION

The present invention relates to a dielectric resonator in which a strip line is formed three-dimensionally on a dielectric substrate, and a dielectric filter using such a dielectric resonator.

A filter for microwaves is known which uses a resonator consisting of a strip line. For example, a $\frac{1}{4}$ wavelength resonator is formed such that one end of a linear strip line type resonator conductor provided on a dielectric substrate is set free and the other end thereof is short-circuited to an earth electrode. The resonator conductor is set to a length which is an odd number of times as large as $\frac{1}{4}$ of the resonance wavelength. In order to actually form a filter, such resonator conductors are arranged on a dielectric substrate, and the short-circuited ends thereof are connected together, the distance between adjacent resonator conductors being so determined that the degree of coupling corresponds to the filter characteristics.

In the field of $\frac{1}{2}$ wavelength resonators a technique for forming a resonator conductor may be provided on a dielectric substrate in the shape of a hairpin as disclosed in Japanese Patent Publication (Unexamined) Nos. 62-193302/1987 and 58-103202/1983. By the technique, an actual filter is so formed that a plurality of hairpin-shaped resonator conductors are parallel-connected together.

In any case, conventional strip line type filters are such that predetermined resonator conductors are provided on a dielectric substrate. Namely, the resonator conductors are arranged in a planar configuration. For example, conductive paste is laid in a predetermined shape on a dielectric substrate by screen printing, or in a dielectric substrate in a recess of predetermined shape where an electrode is formed or is made. Then, the interior of the recess is filled with conductive paste. The dielectric substrate is then heated to bond the conductive paste thereto by firing and form a desired electrode pattern. There is another example having a triplate structure in which a thin conductive plate (resonator conductor), molded into a predetermined shape in advance by punching or etching, is sandwiched between two dielectric substrates as shown in Japanese Patent Publication (Unexamined) No. 57-204602/1982.

In any of these conventional strip line type filters, resonator conductors are arranged, in a plane, on a dielectric substrate, so that the areas of the filters cannot be reduced. Especially, in the case where resonator conductors are connected in a plurality of steps to form a filter, the horizontal size of the filter necessarily increases, even though the height thereof is unchanged.

In the resonator pattern obtained by screen printing, the printing accuracy is generally low, and the frequency and degree of coupling vary, so that it becomes necessary to subject such a resonator pattern to trimming. In the case where a recess formed in a dielectric substrate is filled with conductive material, the conductive material unavoidably adheres extensively to even an unnecessary portion of the substrate in most cases. Consequently, such a conductive material has to be removed, i.e., a troublesome additional operation is required. In the case of a triplate structure, a clearance, the height of which corresponds to the thickness of a conductive plate, is produced between two dielectric substrates due to the presence of the conductive plate. Therefore, the equivalent dielectric constant lowers, and the dimensions of the filter cannot be reduced. Moreover, it is necessary to provide a suitable shielding means for the thickness portions of the conductive plate.

SUMMARY OF THE INVENTION

An object of the present invention is to provide a strip line type dielectric resonator which is free from these drawbacks encountered in the conventional technique, i.e., the variation of the size of an electrode formed by screen printing, the difficulty in applying a conductive paste to the interior of a recess and the inconvenience due to the thickness of the electrode of the conductive plate in a triplate structure, and which is suitably miniaturized and easily incorporated in a circuit.

The present invention is directed to a folded strip line type dielectric resonator using a generally U-shaped dielectric substrate as a whole obtained by partly forming a cutout portion in a flat substrate, in which an electrode is formed on the outer circumferential portion thereof exclusive of one of two primary surfaces thereof and two end surfaces close to the outer part of the cutout portion. The terms "primary surfaces" of the dielectric substrate are the two surfaces where the dielectric substrate is viewed in the shape of a letter "U". The "cutout portion" means not only a cutout made mechanically actually in the substrate but also a recess formed resultantly in a part of the substrate.

In order to provide an input-output coupling electrode to a folded strip line type dielectric resonator, an independent island electrode is formed on the outer circumferential portion of a substrate which is close to a non-electrode end surface out of both end surfaces of the cutout portion thereof, to use this island electrode as an input-output coupling electrode. It is also effective to form a wavy or undulated wall surface of the cutout portion formed in a dielectric substrate, or filling the cutout portion formed in a dielectric substrate with another dielectric material.

Another example of the strip line type dielectric resonator according to the present invention is formed by bonding separate substrates to both of the primary surface of a dielectric resonator having an island electrode (input-output coupling electrode) as described above, to form a three-layer sandwich structure, in which each of the outside dielectric substrates has an earth electrode on the outer circumferential surface thereof exclusive of the portion in the vicinity of the island electrode of the inside-positioned dielectric resonator and also on the outer primary surface thereof.

According to the present invention, providing the above-described electrode structure by using a U-shaped dielectric substrate is identical with forming such an electrode structure by folding a strip line in two. Out of the two end surfaces at the cutout portion of the dielectric resonator, the end surface on which the electrode is formed constitutes a short-circuited end surface, while the end surface on which the electrode is not formed constitutes an open end surface. Therefore, since a $\frac{1}{4}$ wavelength strip line is folded, the length of the dielectric resonator becomes less than a half of that of a conventional dielectric resonator, so that the dimensions of the dielectric resonator are reduced to a great extent.

Moreover, since this folded strip line type resonator has a three-dimensionally folded electrode structure unlike conventional resonators of this kind having a two-dimensionally folded electrode structure, it enables a multistage filter to be formed to extremely small dimensions advantageously by stacking a plurality of resonators in the direction of their primary surfaces (via their coupling dielectric substrates thereamong).

Another mode of the present invention is a folded strip line type dielectric resonator using a flat dielectric substrate and having a U-shaped outer electrode on the outer circumferential surface thereof exclusive of the two primary surfaces thereof, a U-shaped intermediate electrode on the inner portion thereof, a central electrode on the inner portion thereof, and a central electrode on the central portion thereof, those electrodes being short-circuited only at one end of each thereof on the outer circumferential surface of the dielectric substrate.

More specifically, this structure is, for example, a combination of a U-shaped resonator member, in which an electrode is formed on both of two primary surfaces of a dielectric substrate formed into a U-shape by forming a cutout therein, and on the outer circumferential surface thereof exclusive of one of the portions thereof which are in the vicinity of both of the cutout-defining ends thereof, and an inner resonator member, which consists of a separate dielectric piece having a U-shaped electrode on the outer circumferential surface thereof to which only one end of a central partial electrode is connected, the inner resonator member being housed unitarily in the cutout in the U-shaped resonator member, so that the non-electrode-carrying end surfaces of these resonator members are flush with each other.

Another object of the present invention is to provide a small multilayer dielectric filter which can be incorporated easily in a circuit on a mounting board.

A structure which achieves this object is basically a multilayer dielectric filter of the type in which folded strip line type dielectric resonator substrates and coupling-adjusting dielectrics are stacked alternately in the direction of the thickness thereof unitarily. The dielectric resonator substrate referred to above is formed by three-dimensionally providing a folded strip line on the surface of a dielectric substrate exclusive of the two primary surfaces thereof. The coupling-adjusting dielectric has an electrode on the outer circumferential portion thereof. A plurality of such dielectric resonator substrates are stacked with such coupling-adjusting dielectrics inserted therebetween. Outer dielectrics are provided on the outer sides of the dielectric resonator substrates positioned on both sides of the filter with respect to the direction of the thickness thereof. Each of these outer dielectrics is provided with an electrode on the outer circumferential portion of the outer primary surface thereof. Independent island electrodes are formed on the outer portions of the dielectric resonator substrates positioned on both sides of the structure, and these island electrodes are used as input-output coupling electrodes.

An example of this folded strip line type dielectric resonator is a structure in which an electrode is formed on both two primary surfaces of a dielectric substrate formed into a U-shape as a whole by forming a cutout therein and on the outer circumferential surface thereof exclusive of one of the portions thereof which are in the vicinity of both of the cutout-defining ends thereof. Another example has a dielectric substrate, a U-shaped outer electrode formed on the outer circumferential surface of the substrate exclusive of the two primary surfaces thereof, a U-shaped intermediate electrode formed on the inner portion of the substrate, and a central electrode formed on the central portion thereof. These electrodes are each short-circuited at only one end thereof on the outer circumferential surface thereof. The coupling degree adjusting dielectrics include, in addition to a simple flat dielectric substrate, a structure formed by making an opening or a cutout in a dielectric so as to adjust the degree of coupling. A non-conductive bonding agent may be substituted for the substrate.

A dielectric resonator substrate has a shape so that a strip line type electrode is formed as if it were bent three-dimensionally and fixed on the outer circumferential surface or inner surface of a dielectric substrate. At one end of the outer circumferential surface of the substrate, a non-electrode-carrying portion (portion on which an electrode is not formed) constitutes an open end, while an electrode-carrying portion constitutes a short-circuited end. Therefore, since a $\frac{1}{4}$ wavelength strip line is folded, the length of the substrate is reduced to less than a half of that of a conventional substrate of this kind, i.e., the dielectric resonator substitute is miniaturized to a great extent. A coupling dielectric between such dielectric resonator substrates is adapted to adjust the degree of coupling between adjacent resonators in accordance with the thickness of the dielectric and the shaped and position of the opening and cutout therein.

On this dielectric resonator substrate, the strip is folded three-dimensionally and not planarly unlike conventional substrates of this kind. Accordingly, when dielectric resonator substrates are stacked in the direction of the thickness thereof with coupling degree adjusting dielectric substrates inserted thereamong, a dielectric filter having a desired number of stages can be produced easily to very advantageously small dimensions.

Still another object of the present invention is to provide a unitary dielectric filter which is free from the above-mentioned drawbacks encountered in the prior art dielectric filters which involve problems of the variation of the size of an electrode ascribed to the screen printing, the difficulty in applying conductive paste to the surface of a recess and the inconvenience due to the thickness of a conductive plate electrode in a triplate structure, and which permits a multistage filter to be formed easily, the dimensions of a dielectric filter as a whole to be reduced, and a dielectric filter to have a structure such that the dielectric filter can be incorporated easily in the circuit on a mouting substrate.

In another embodiment of the present invention, there is provided a dielectric filter, for achieving this object, having coupling degree adjusting slits in a folded strip line-carrying dielectric resonator block, the block being divided into a plurality of folded strip line type dielectric resonators by these slits, while maintaining the unitary condition of the resonators. Outer dielectrics are provided on and bonded to both sides of the dielectric resonator block. Each outer dielectric has an electrode on the outer circumferential surface thereof except its outer primary surface. An independent island electrode is formed on the outer side portion of each of the dielectric resonators positioned on both ends of the resonator block, and this island electrode is used as an input-output coupling electrode.

In an example, the folded strip line type dielectric resonator block has a cutout extending in the longitudinal direction of one side surface thereof so that the block has a U-shaped cross section. The block has an electrode on the outer surface thereof exclusive of both end surfaces thereof and one of two surface portions thereof which are in the vicinity of the open side of the cutout. In another example, a U-shaped outer electrode is formed on the outer circumferential surface of a cross-sectionally U-shaped outer dielectric block except both end surfaces thereof. An inner dielectric block has a U-shaped intermediate electrode, and a central electrode at the central portion thereof is provided in the inner portion of the outer dielectric block. These electrodes are each short-circuited only on one side thereof on the outer circumferential surface of the dielectric blocks.

The slits formed in a dielectric resonator may be left empty or filled with another dielectric. In the latter case, flat dielectric members may be inserted, or dielectric plates having an opening or a cutout in a part of each thereof may be inserted. The slits may be filled with a dielectric material instead of inserting plates of a dielectric therein.

PREFERRED EMBODIMENTS OF THE INVENTION

Figure 1:
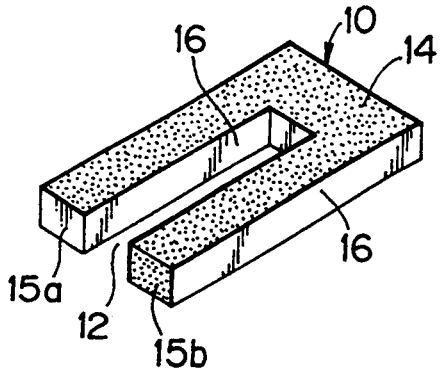
FIG. 1 is a perspective view of a folded strip line type dielectric resonator according to an embodiment of the present invention.

Referring to FIG. 1, a folded strip line type dielectric resonator according to the present invention is formed by making a cutout 12 in a part of a dielectric substrate 10 so as to form the substrate 10 as a whole substantially in a U-shape, and forming electrodes 16 on the whole outer circumferential portion (the outer surface of the substrate and the inner surface of the cutout) exclusive of both primary surface 14 (the upper and lower surfaces of the dielectric substrate 10 in this embodiment) and one (end surface **15*b* in the illustrated embodiment) of both end surfaces 15*a*, 15*b* of an opened portion of the cutout. The dielectric substrate 10 consists of a sintered body of a material, for example barium titanate, of a high dielectric constant, which is usually used for a filter for microwaves, for example. The electrodes 16** are formed by applying conductive paste to the dielectric substrate and firing the same. For appreciation of the illustrated resonator, the portions on which the electrodes are formed are partially hatched, and the non-electroded-carrying portion (i.e., the portions where the ground surface of the dielectric is exposed) are dotted like a mat surface.

Figure 2:
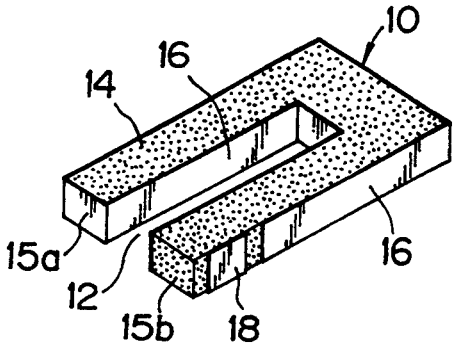
FIG. 2 is a perspective view of the resonator of FIG. 1 with an input-output coupling electrode provided thereon.

FIG. 2 shows an example in which an input-output coupling electrode is provided on this folded strip line type dielectric resonator. In the basic structure of FIG. 1, an independent island electrode 18 is formed on the outer circumferential portion which is in the vicinity of a non-electrode-carrying end surface **15*b* out of the end surfaces 15*a*, 15*b* at the opened portion. This island electrode 18** may consist of an input-output coupling electrode.

Such a folded strip line type dielectric resonator can be regarded as a structure obtained by folding in two $\frac{1}{4}$ wavelength resonator, each consisting of a long thin rod of dielectric with a U-shaped electrode formed on the outer surface thereof. A miniaturized resonator is thus formed by effectively utilizing a dielectric material.

Although this resonator structure may be manufactured by a method comprising the steps of forming U-shaped dielectric substructures, and then forming an electrode on each of the dielectric substrates, it is desirable to employ a method comprising the steps of preparing a cross-sectionally U-shaped long block made of a dielectric material, applying an electrode material to predetermined portions and to predetermined faces of the outer circumferential sides of the block, firing the same, and cutting the resultant product into pieces of a predetermined thickness. A plurality of dielectric resonators having the same characteristics can be mass-produced by this method. In order to produce a cross-sectionally U-shaped long block, for example, in a method of molding a cross-sectionally U-shaped elongated block and firing the same, it is possible to form grooves in a long block of a sintered body or dispose a plate of a large width on both sides of a plate of a small width and bond them to one another with glass.

Figure 3:
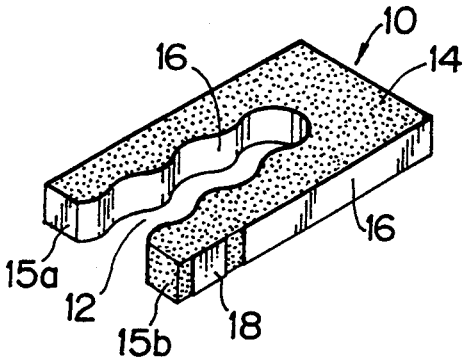
FIG. 3 is a perspective view of a modified example of the resonator shown in FIGS. 1 and 2.
Figure 4:
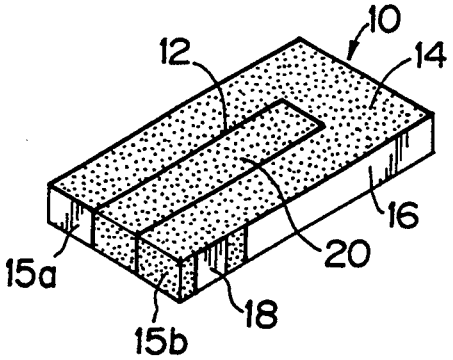
FIGS. 4 and 5 are perspective views of modified examples of FIGS. 2 and 3, each of which has a cutout filled with a dielectric element as an additional member.
Figure 5:
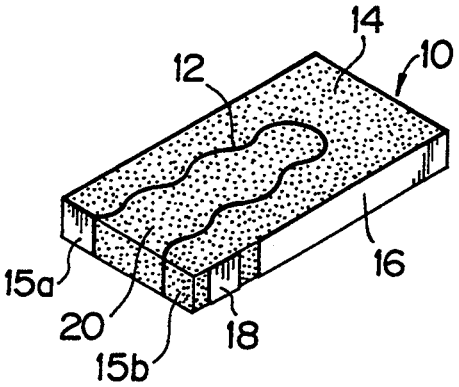

FIG. 3 shows another embodiment of the dielectric resonator according to the present invention. This embodiment is basically identical to the embodiment of FIG. 2 except the shape of the cutout 12. In the embodiment of FIG. 3, the wall surface of the cutout 12 is undulated. Owing to the undulated wall surface, the length of the electrode increases correspondingly, and this enables the resonator to be further minimized. It is also effective to fill the cutout with a dielectric member 20 different from the dielectric substrate as shown in FIGS. 4 and 5. This causes the specific band width to be reduced, so that the Q-factor is improved. The mechanical strength of the resonator also increases. FIG. 4 shows an embodiment having a linearly extending cutout 12, and FIG. 5 an embodiment having an undulately extending cutout 12. The separate dielectric member 20 in the cutout 12 may be formed out of a material identical with that of the dielectric substrate 10 or a material different therefrom. It will be appreciated that a structure can be used by removing the island electrode 18 from the structures shown in FIGS. 3, 4 and 5.

Figure 6A:
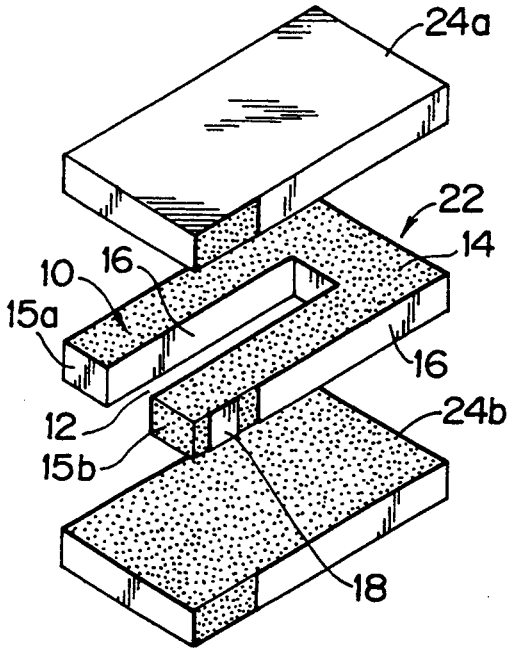
FIGS. 6A and 6B are perspective views of a dielectric resonator of a three-layer sandwich structure of still another embodiment of the present invention.
Figure 6B:
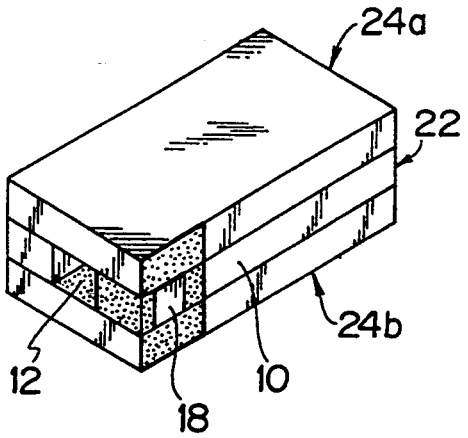

FIGS. 6A and 6B show still another embodiment of the invention. As shown in FIG. 6A, independently formed dielectric substrates 24*a* and 24*b* are provided on the upper and lower primary surfaces of a dielectric resonator 22 consisting of a dielectric substrate 10 having an island electrode 18 thereon, and these substrates are bonded to one another as shown in FIG. 6B, to form a three-layer sandwich structure. Although the construction of the dielectric resonator 22 in this embodiment is identical with that of the embodiment of FIG. 2, the construction shown in FIGS. 3–5 may also be employed. Each of the outside dielectric substrates 24*a*, 24*b* is provided with an electrode on the outer circumferential surface thereof exclusive of the portion thereof which is in the vicinity of the island electrode 18 on the inside dielectric resonator 20 and on the outer primary surface thereof. Accordingly, the whole of the top surface of the upper dielectric substrate 24*a* constitutes an electrode surface, and the lower surface a non-electrode-carrying surface (surface on which the ground of the dielectric is exposed). Conversely, the upper surface of the lower dielectric substrate 24 constitutes a non-electrode-carrying surface, and the whole of the bottom surface an electrode surface.

Figure 7:
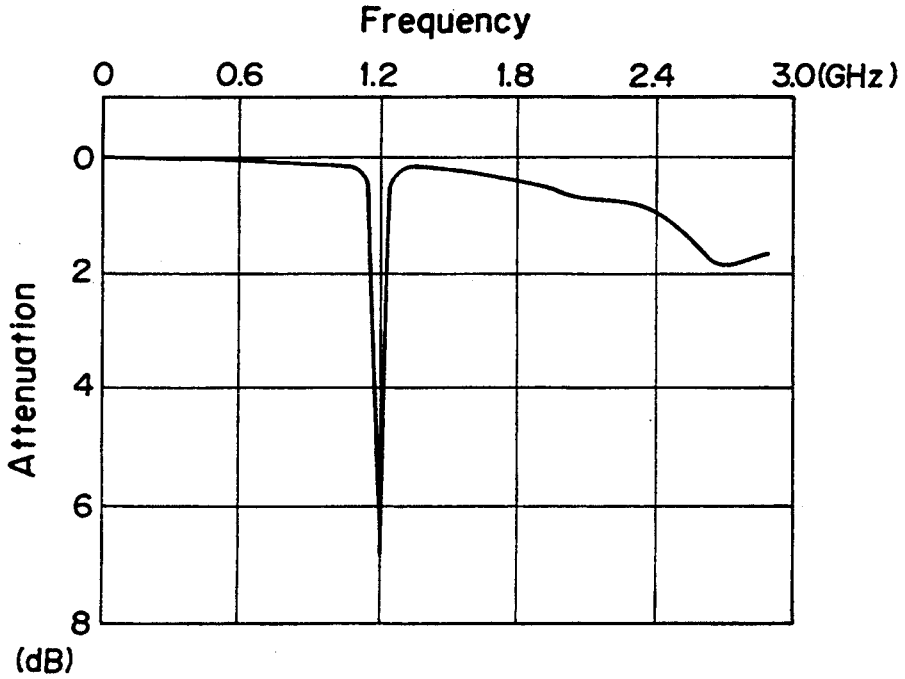
FIG. 7 is a graph showing the results of measurement of the filter characteristics of the dielectric resonator of a three-layer sandwich structure of FIG. 6B.

A dielectric resonator of a three-layer sandwich structure which is identical with the embodiment of FIG. 6B (but the shape of the electrode on the dielectric resonator constituting an inner intermediate layer is little different) was produced for trial, and the filter characteristics thereof were determined. The results are shown in FIG. 7. The length and width of each electrode substrate are about 6.5 mm respectively, and the thickness thereof about 1 mm. The band-stop filter characteristics including an attenuation of about 7 dB at the central frequency of about 1.2 GHz were obtained by this structure. Since this is an experimental product, the attenuation factor at frequencies out of the band is insufficient but it is considered to be able to improve the attenuation by by employing a suitable grounding (earthing) method, changing the electrode structure suitably and employing a suitable lead-out method.

In this embodiment, an electrode is formed on the outer peripheral portion of a generally U-shaped dielectric substrate exclusive of both of two primary surface thereof and either of the two end surfaces including their vicinities of the outer peripheral at the opened portion of the cutout. Consequently, this structure is equivalent to a structure formed by folding a $\frac{1}{4}$ wavelength resonator conductor to a length smaller than a half of that of the conventional resonator conductors, i.e., the resonator conductor is miniaturized greatly. Moreover, this folded strip line is bent three-dimensionally, unlike the conventional folded strip lines which are bent planarly. Therefore, when a multistage filter, consisting of a multilayer resonator body, is formed, the dimensions thereof can be further reduced. Since this filter can be mounted on a surface of a small area, machines and devices can be miniaturized advantageously. Moreover, since the outer electrode and island electrode (input-output-coupling electrode) can be surface-bonded to a circuit pattern on a mounting board, the matching can be carried out easily.

Figure 8:
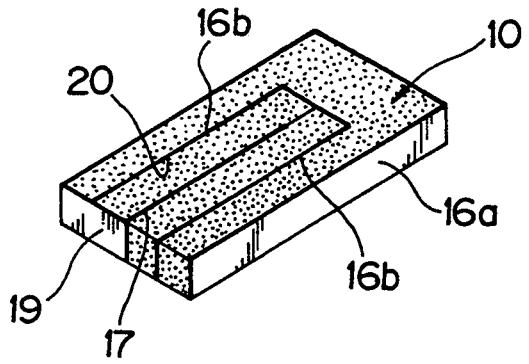
FIGS. 8 and 9 are perspective view and an exploded perspective view, respectively, of the dielectric resonator according to a further embodiment of the present invention.

FIG. 8 shows still another embodiment of the folded strip line type dielectric resonator according to the present invention. This embodiment uses a flat dielectric substrate 10 having a U-shaped outer electrode 16*a* formed on the outer peripheral surface (three surface portions) exclusive of the two primary surfaces thereof, a U-shaped intermediate electrode 16*b* so formed on the inner portion of the dielectric substrate 10 as to face in the same direction as that of the outer electrode 16*a*, and a central electrode 17 formed on the central portion of the substrate, these electrodes 16*a*, 16*b*, 17 being short-circuited only at one end of each thereof on the outer circumferential surface of the dielectric substrate by short-circuiting electrode 19. The dielectric substrate 10 consists of a sintered body of a material, for example barium titanate, of a high dielectric constant, which is ordinarily used for a filter for microwaves. The electrodes 16*a*, 16*b*, 17 are formed by applying conductive paste to the dielectric substrate and firing the same.

Figure 9:
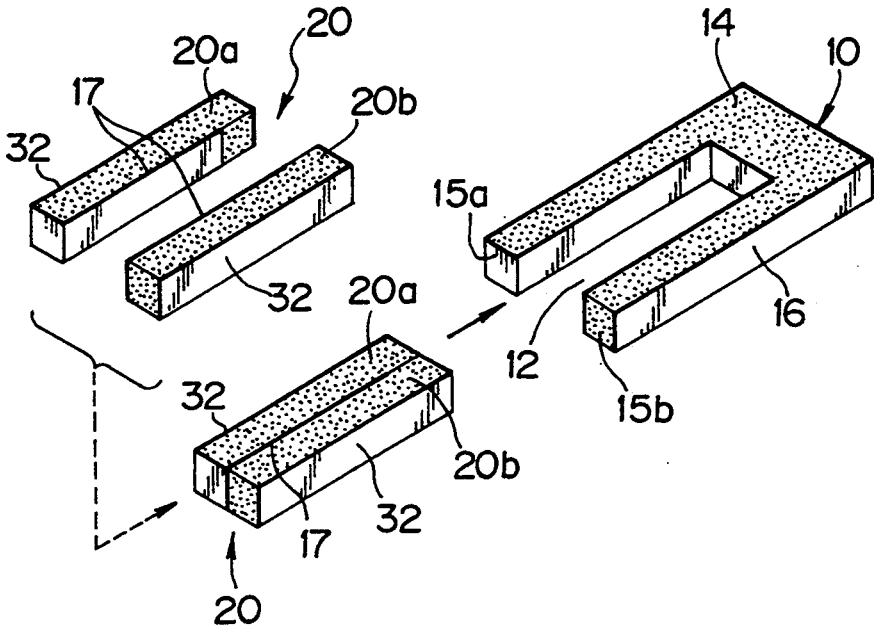

More specifically, such a dielectric resonator can be manufactured by combining together the constituent parts shown in, for example, FIG. 9. A cutout 12 is provided in a portion of a dielectric substrate 10 so as to form the substrate as a whole substantially in the shape of a letter "U", and an electrode 16 is formed on the whole of the outer circumferential portions (outer surface of the substrate and the inner surface of the cutout) thereof exclusive of both of the primary surface 14 (the upper and lower surfaces of the dielectric substrate 10 in the case of this embodiment) of this U-shaped dielectric substrate 10 and either (which is designated by a reference numeral 15*b* in the case of this embodiment) of both end surfaces 15*a*, 15*b* of the opened portion of the cutout, to obtain a U-shaped resonator. Two dielectric pieces 20*a*, 20*b* which are formed separately from this U-shaped resonator are prepared. These pieces 20*a*, 20*b* are shaped so that the joined body 20 thereof is just fitted in the cutout 12 in the dielectric substrate 10. Partial central electrodes 17 are formed on the portions of the joint surfaces of the dielectric pieces 20*a*, 20*b* extending from one end thereof to the positions in the vicinity of the other ends thereof (the electrodes 17 do not reach the other ends of the joint surfaces), and electrodes 32 are formed on the outer peripheral surfaces of the dielectric pieces exclusive of one end surface of one dielectric piece (dielectric piece 20*b* in this embodiment), to obtain inner resonators. The inner resonators are then fitted in the cutout 12 in the U-shaped resonator with the non-electrode-carrying end surface being flush with the electrode-carrying end surface into one body by bonding them to one another with glass. During this time, the electrode on the end surface 15*a* at the opened portion of the cutout in the U-shaped resonator and the electrode on the end surface of the dielectric pieces 20*a* are electrically connected.

Figure 10:
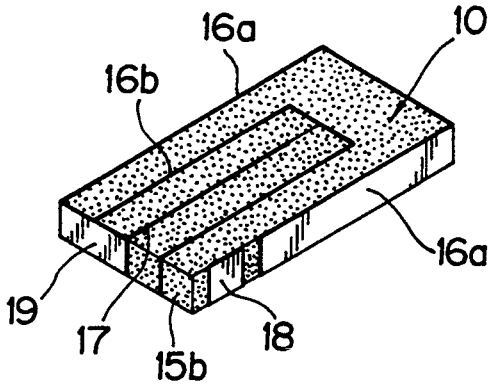
FIG. 10 is a perspective view of a modified example of the structure of FIG. 8 with an input-output coupling electrode provided thereon.

FIG. 10 shows a case where an input-output coupling electrode is provided on such a resonator as those described above. In order to provide such an input-output coupling electrode, an independent island electrode 18 may be formed on the portion of the outer circumferential surface of the resonator which is close to the non-electrode-carrying end surface 15*b* in the basic structure of FIG. 8. This island electrode 18 can be used as an input-output coupling electrode. The construction of the remaining portions of the resonator may be identical with that of the corresponding portions of the embodiment of FIGS. 8 and 9. Accordingly, the corresponding portions are designated by the same reference numerals, and the description thereof are omitted.

Such a folded strip line type dielectric resonator can be regarded as a dielectric resonator which is as good as, or equivalent to, a structure obtained by folding in two a strip line type $\frac{1}{4}$ wavelength resonator which is formed by providing an electrode in the shape of a letter "W" on both of the outer side surfaces and the inner side surface of a long rod type dielectric, and it consists of a miniaturized structure utilizing a dielectric material effectively.

Figure 11:
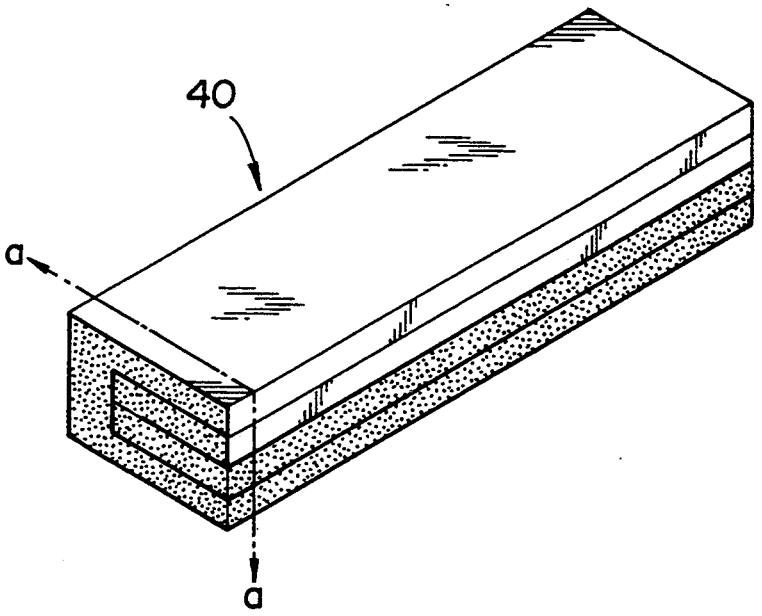
FIG. 11 is a perspective view of a modified example of the structure shown in FIG. 8 on which an input-output coupling electrode is provided.

Although this dielectric resonator may be manufactured by a method comprising the steps of molding U-shaped dielectric substrates, forming an electrode on each of the substrates, and inserting separetely formed inner resonators into the cutout of each substrate, it is preferably manufactured by preparing in advance a long structure 40 which is cross-sectionally identical with the above-mentioned resonator, and cutting the structure 40 along an imaginary line a—a so that a resonator piece of a predetermined thickness is obtained as shown in FIG. 11. This method enables dielectric resonators of the same characteristics to be mass-produced easily. The structure 40 can be manufactured by various methods. For example, a cross-sectionally U-shaped long block made of a dielectric material is prepared (a dielectric material is molded in advance into a cross-sectionally U-shaped long block, and the block is then sintered; or grooves are made in a sintered long block), and an electrode material is then applied to a predetermined portion of a predetermined surface of the outer circumference thereof, the electrode material being thereafter fired. The predetermined portions of two dielectric substrates of the inner long blocks are applied with electrode material firing the electrode material, and then joining the substrates to each other. The resultant inner long blocks are fitted in the cutout in the cross-sectionally U-shaped long block into one body. Still another method may be used in which five dielectric substrates are stuck on one another with a glass bonding agent so as to form at a time a long structure having a desired cross-sectional shape.

Figure 12A:
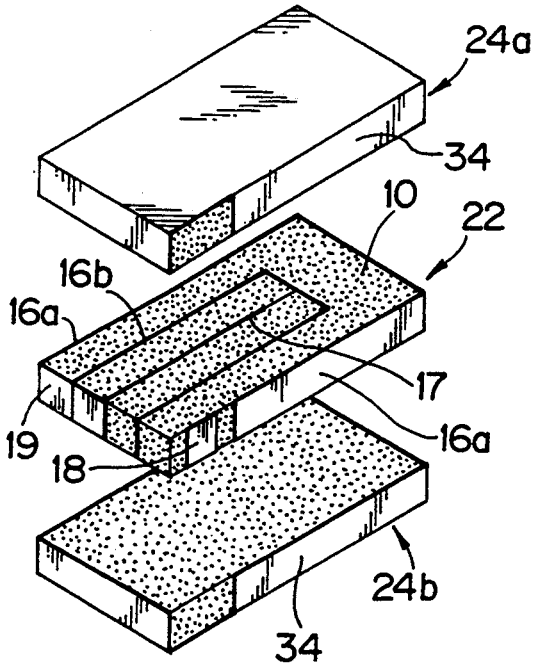
FIGS. 12A and 12B are perspective views of a three-layer sandwich structure in which separate dielectric substrates are provided on both sides of the dielectric resonator of FIG. 10.
Figure 12B:
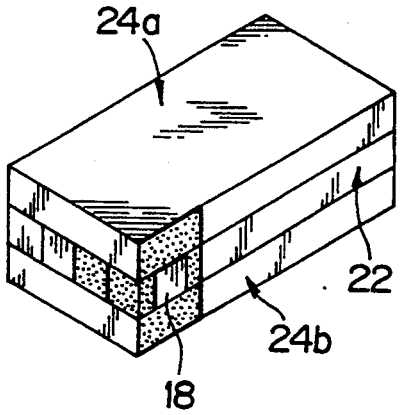

FIGS. 12A and 12B show a further embodiment. As shown in FIG. 12A, separately formed dielectric substrates 24*a*, 24*b* are arranged on both main surfaces of a dielectric resonator 22 (identical with the dielectric resonator of the construction shown in FIG. 10) having an island electrode 18, and these three members are bonded together to form a three-layer sandwich structure as shown in FIG. 12B. Each of the outside dielectric substrates 24*a*, 24*b* has an electrode 34 on the outer circumferential surface thereof exclusive of the portion close to the island electrode 18 on the inside dielectric resonator and on the outer primary surface thereof. Accordingly, the whole of the top surface of the upper dielectric substrate 24*a* constitutes an electrode surface, and the lower surface thereof a non-electrode surface where the ground of the dielectric is exposed. Conversely, the upper surface of the lower dielectric substrate 24*b* constitutes a non-electrode surface, and the whole of the bottom surface thereof an electrode surface.

Figure 13:
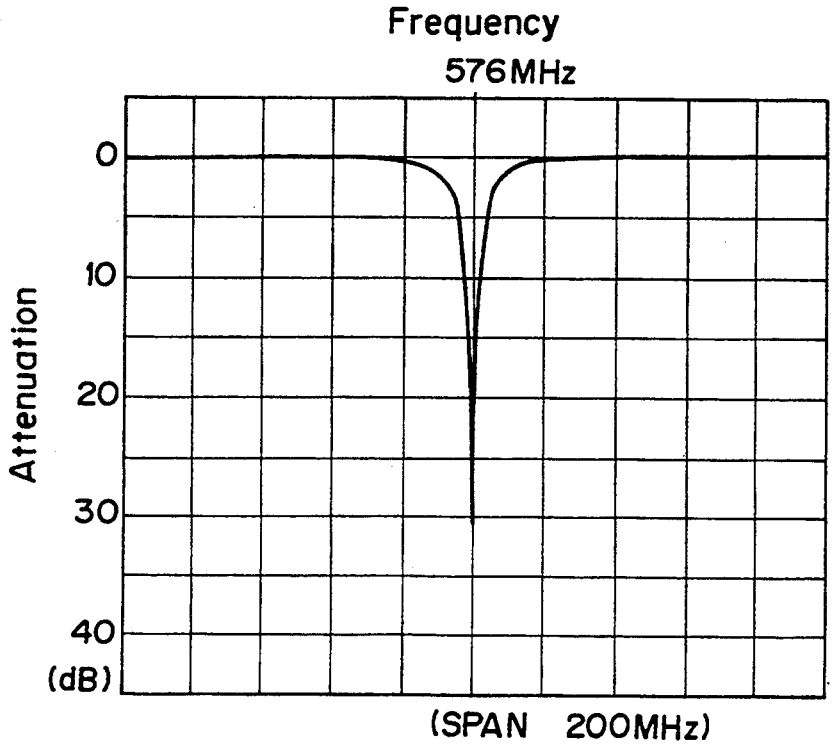
FIG. 13 is a graph showing the filter characteristics of the dielectric resonator of a three-layer sandwich structure of FIG. 12B.

A dielectric resonator of a three-layer sandwich structure identical with the dielectric resonator of FIG. 12B was produced experimentally, and the filter characteristics were determined. The results are shown in FIG. 13. Each of the dielectric substrates is about 10 mm in length (the longitudinal direction of the U-shaped body), about 2.8 mm in width (the lateral direction). The cutout in the U-shaped body is about 9 mm in depth, and about 1 mm in thickness. The band-stop filter characteristics including an attenuation of about 31 dB at the central frequency of about 576 MHz were obtained from this structure.

In the structures of FIGS. 8–12B, a U-shaped outer electrode, a U-shaped intermediate electrode and a central electrode are formed on a dielectric substrate and short-circuited only at one end of each thereof as described above. Consequently, this structure is formed by folding a $\frac{1}{4}$ wavelength resonator conductor to a length shorter than a half of that of conventional resonator conductors, just as the previously-described embodiment. The resonator conductor is miniaturized greatly. Moreover, this folded strip line is bent three-dimensionally unlike conventional folded strip lines which are bent planarly. Therefore, when a multistage filter consisting of a multilayer body of a plurality of resonators is formed, the dimensions thereof can be further reduced. Since this filter can be mounted on a surface of a small area, machines and devices using this filter can be miniaturized advantageously. Moreover, since the outer electrode and island electrode (input-output coupling electrode) can be surface-bonded to a circuit pattern on a mounting board, the matching can be carried out easily.

Figure 14:
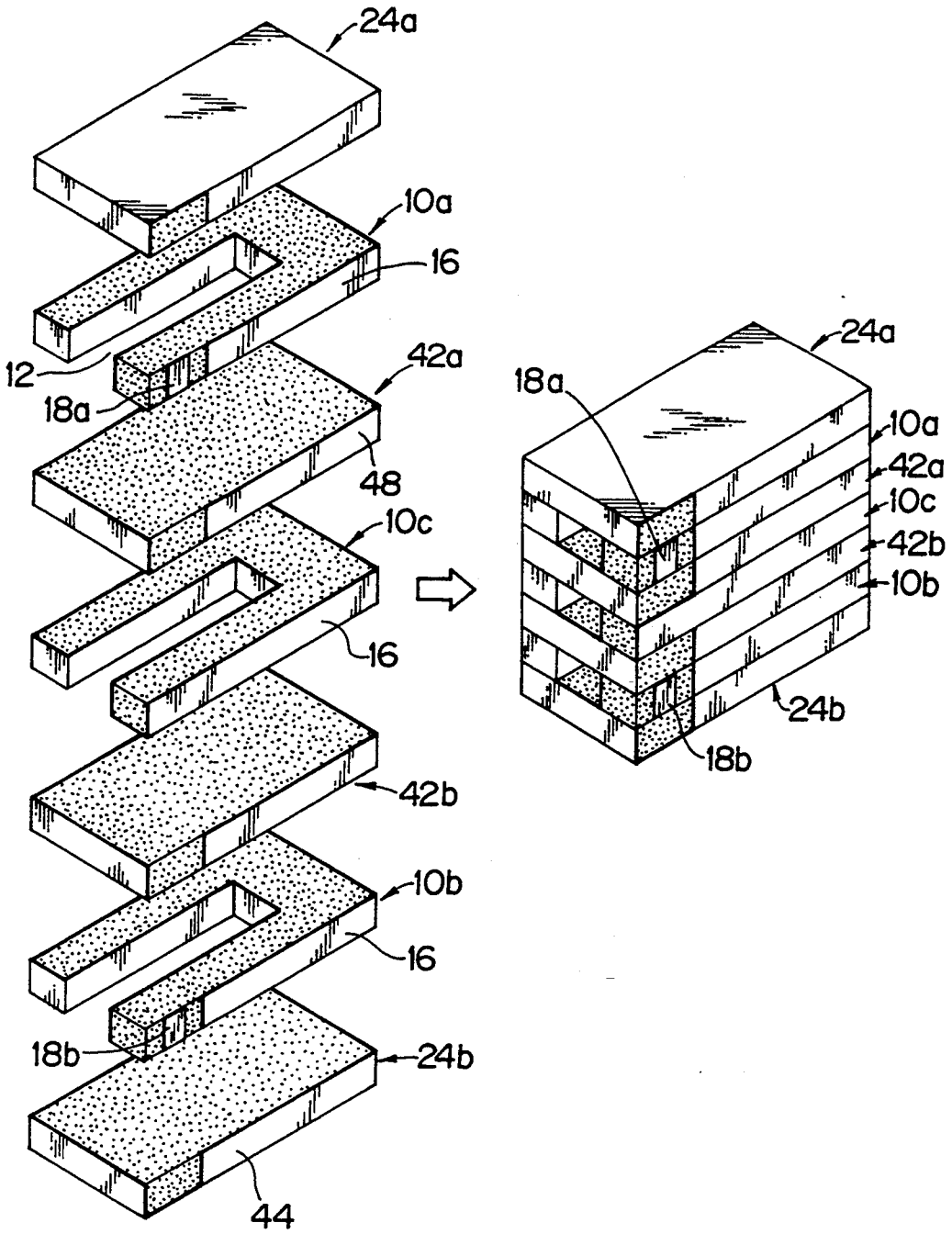
FIG. 14 is a perspective view of a modified example of the structure of FIG. 6B, showing how to assemble a three-stage multilayer dielectric filter.

FIG. 14 shows another embodiment of the multilayer dielectric filter according to the present invention. This embodiment shows an example of the construction of a three-stage filter. This multilayer dielectric filter is of the type in which folded line type dielectric resonator substrates 10*a*, 10*b*, 10*c* and two coupling adjusting dielectric substrates 42*a*, 42*b* are stacked alternately in the direction of the thickness thereof. In addition, outer dielectric substrates 24*a*, 24*b* are disposed on the dielectric resonator substrates 10*a*, 10*b* which are placed on both sides in the direction of the thickness of the filter, and all of these dielectric substrates are aligned accurately and joined unitarily with a bonding agent. Independent island electrodes 18*a*, 18*b* are provided on the outer circumferential portions of the dielectric resonator substrates 10*a*, 10*b* positioned on upper and lower parts of the filter which are close to the non-electrode-carrying end surface of the same substrates, and these electrodes are used as input-output coupling electrodes.

Each of the dielectric resonator substrates 10*a*, 10*b*, 10*c* has a structure in which a folded strip line is formed three-dimensionally on the outer surface thereof exclusive of the two primary surface thereof. In this embodiment, a cutout 12 is formed in each of the dielectric substrates 10*a*, 10*b*, 10*c* so that each substrate has a substantially U-shaped cross section, and an electrode 16 is formed on the outer circumferential portion of the substrate (outer surface of the substrate and the inner surface of the cutout) exclusive of the two primary surfaces (i.e., outer and inner surfaces) of the substrate and either one of the surface portions thereof which are close to both end surface at the opened portion of the cutout. One (non-electrode-carrying side) of the end surfaces at the opened portion of the cutout constitutes an opened side, and the other, the end surface on which the electrode is formed, a short-circuited side. The island electrodes 18*a*, 18*b* are provided on the dielectric resonator substrates 10*a*, 10*b* positioned on both side portions of the filter in such a way that they are on the portions of the outer circumferential surfaces thereof which are close to the non-electrode-carrying end surfaces thereof and are away from the other electrodes. The coupling degree adjusting dielectric substrates 42*a*, 42*b* have electrodes 48 on their outer circumferential surfaces (a part of each of which is excluded) exclusive of the primary surfaces thereof. The outer dielectric substrates 24*a*, 24*b* have electrodes 44 on their outer primary surfaces and outer circumferential surfaces (a part of which is excluded). The surface portions of the coupling degree adjusting dielectric substrates 42*a*, 42*b* and outer dielectric substrates 24*a*, 24*b* which are in the vicinity of the electrodes 48, 44 thereon shall be non-electrode-carrying portions so that the electrodes 48, 44 are not connected to the island electrodes 18*a*, 18*b*. The cutouts 12 in the U-shaped dielectric substrates 10*a*, 10*b* 10*c* may be filled with separately formed dielectric members (not shown) just as the cutout in the embodiment of FIG. 4. This causes the Q-factor to increase, and the mechanical strength to be improved.

Figure 15A:
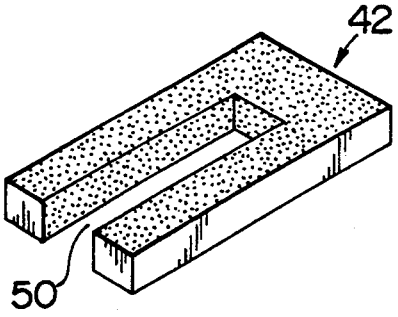
FIGS. 15A and 15B are perspective views of examples of coupling degree adjusting dielectric substrates which can be employed in the present invention.
Figure 15B:
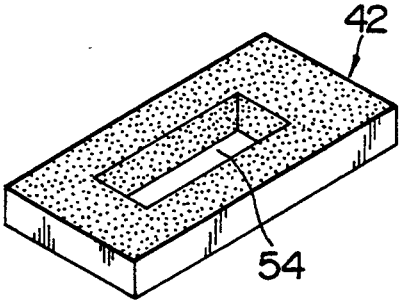

FIGS. 15A and 15B show other examples of coupling degree adjusting dielectric substrates which can be employed in the structure of FIG. 14. A coupling degree adjusting dielectric substrate 42 shown in FIG. 15A has a cutout 50 in a part thereof. A coupling degree adjusting dielectric substrate 42 shown in FIG. 15B has an opening 54 in the central portion thereof. An electrode is formed on the outer circumferential surface only of each substrate, and is not in the cutout and opening. The coupling degrees of adjacent dielectric resonators are determined by adjusting the shape of the cutout 50 or opening 54, whereby the filter characteristics are controlled. Besides this method, varying the thickness of the dielectric substrates also enables the coupling degree adjustment.

Figure 16:
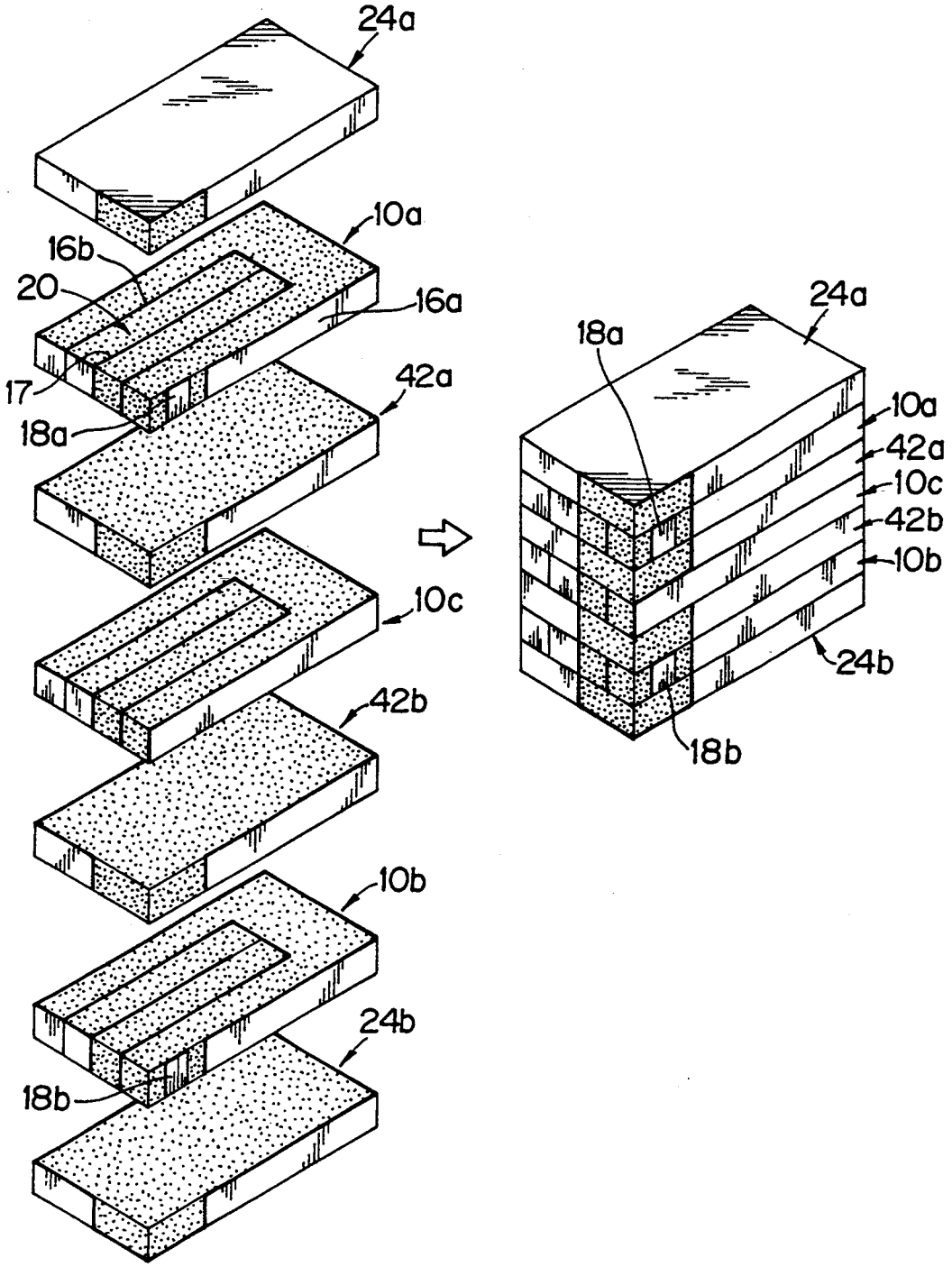
FIG. 16 is a perspective view of the multilayer dielectric filter according to another embodiment of the present invention.

FIG. 16 shows a modified example of FIG. 14. This is also an example of a three-stage filter, the structure of which is basically almost identical with that of the embodiment of FIG. 14 except that of the dielectric resonator substrates. The multilayer dielectric filter of FIG. 16 is of the type in which folded strip line type dielectric resonator substrates 10*a*, 10*b*, 10*c* and coupling degree adjusting dielectric substrates 42*a*, 42*b* are stacked alternately in the direction of the thickness thereof. In addition, outer dielectric substrates 24*a*, 24*b* are disposed on the outer side of the dielectric resonator substrates 10*a*, 10*b* which are positioned on both sides with respect to the direction of the thickness of the multilayer body, and all of the dielectric substrates are positioned accurately, the substrates being then joind unitarily with a bonding agent. The outer circumferential portions of the outer dielectric resonator substrates 10*a*, 10*b* have independent island electrodes 18*a*, 18*b* as input-output-coupling electrodes.

In this embodiment, each of the dielectric resonator substrates 10*a*, 10*b*, 10*c* has a U-shape resonator member consisting of a generally substantially U-shaped substrate of a dielectric in which a cutout is formed, and an electrode 16*a* formed on the outer circumferential portion of the substrate exclusive of both of the primary surfaces thereof and one of the parts of the outer circumferential portions thereof which are in the vicinity of both end surfaces thereof at an opened portion of the cutout. An inner resonator member consists of dielectric pieces 20 formed separately from the U-shaped substrate and having U-shaped electrodes 16*b* on the respective outer circumferential surfaces so that the electrodes 16*b* are connected at one end only thereof to a central partial electrode 17. This inner resonator member is fitted in the cutout in the U-shaped resonator member with the non-electrode-carrying end surfaces thereof being flush with each other, and these resonator members are unitarily joined. The dielectric resonator substrates 10*a*, 10*b* at the outer sides have island electrodes 18*a*, 18*b*. The coupling degree adjusting dielectric substrates may have the construction shown in FIG. 15A or 15B.

Figure 17:
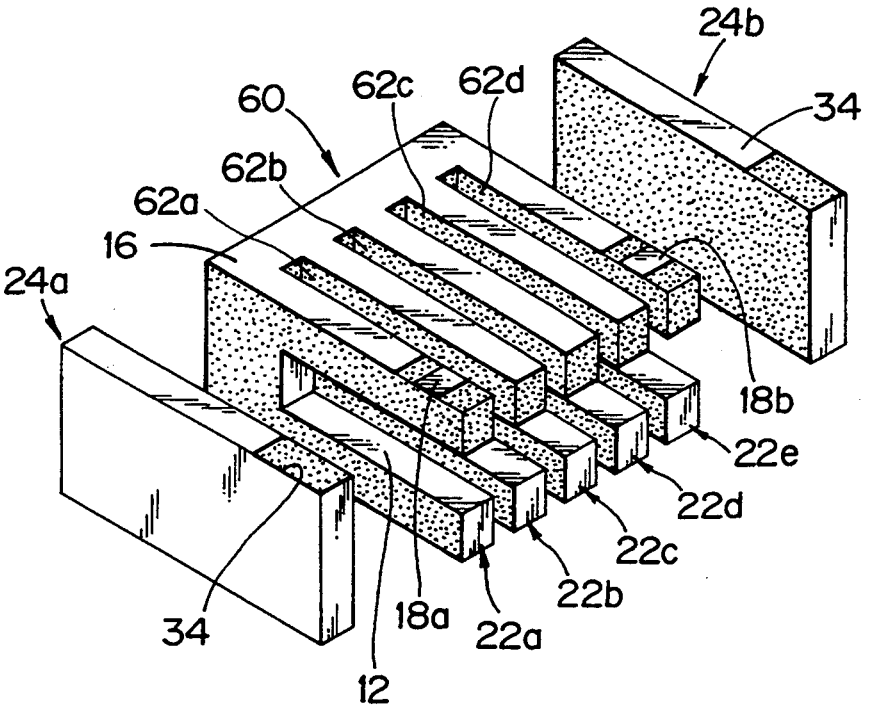
FIG. 17 is an exploded perspective view showing still another embodiment of the present invention consisting of a five-stage unitary dielectric filter.

FIG. 17 shows still another embodiment of the present invention, an example of the construction of a five-stage filter being illustrated therein. This dielectric filter is of the type in which coupling degree adjusting slits 62*a*, 62*b*, 62*c*, 62*d* are formed in four portions of a folded strip line type dielectric resonator block 60, whereby the resonator block is divided into a total of five dielectric resonators 22*a*, 22*b*, 22*c*, 22*d*, 22*e* all of which are connected together at one portion of each thereof. The dielectric resonator block 60 is formed by making a cutout 12 in one side surface (right-hand front surface in FIG. 17) of a rectangular solid dielectric so that the dielectric has a substantially U-shaped cross section, and providing an electrode 16 on the outer circumferential portion (outer surfaces of the dielectric block 60 and inner surface of the cutout 12) exclusive of both end surfaces of the dielectric block 60 and either one (upper surface in FIG. 17) of the surface portions close to both sides of the opened portions of the cutout 12. The slits 62*a*–62*d* are so formed as to extend from the opened portion of the cutout to positions beyond the innermost portion of the cutout 12. Consequently, the dielectric resonators 22*a*–22*e* have folded strip lines formed three-dimensionally on the outer circumferential portions thereof, whereby these resonators are connected together in the direction of the thickness thereof. One (non-electrode-carrying side) of the end surfaces at the opened portion of the cutout constitutes an opened side, and the other electrode-carrying surface a short-circuited side, in the same manner as in the previously-decribed embodiment.

Outer dielectrics 24*a*, 24*b* are disposed on both sides of the dielectric resonator block 60 and bonded thereto unitarily. Each of these outer dielectrics 24*a*, 24*b* has an electrode 34 on the outer primary surface thereof and the outer circumferential portion (exclusive of a part thereof) thereof. Independent island electrodes 18*a*, 18*b* are provided on the parts of the outer circumferential portions of the dielectric resonators 22*a*, 22*b* positioned at both ends which are close to the non-electrode-carrying end surfaces thereof, and these island electrodes are used as input-output coupling electrodes. In order to prevent the electrodes 34 on the outer dielectrics 24*a*, 24*b* from being electrically connected to the island electrodes 18*a*, 24*b*, portions of the outer dielectrics; and which are close to the island electrodes 18*a*, 18*b* are formed as non-electrode-carrying portions.

These dielectrics consist of sintered bodies of a material, e.g., barium titanate, of a high dielectric constant, which is used ordinarily for microwaves, just like the dielectrics in the previous embodiments. The forming of each electrode is done by, for example, coating and baking conductive paste.

Figure 18:
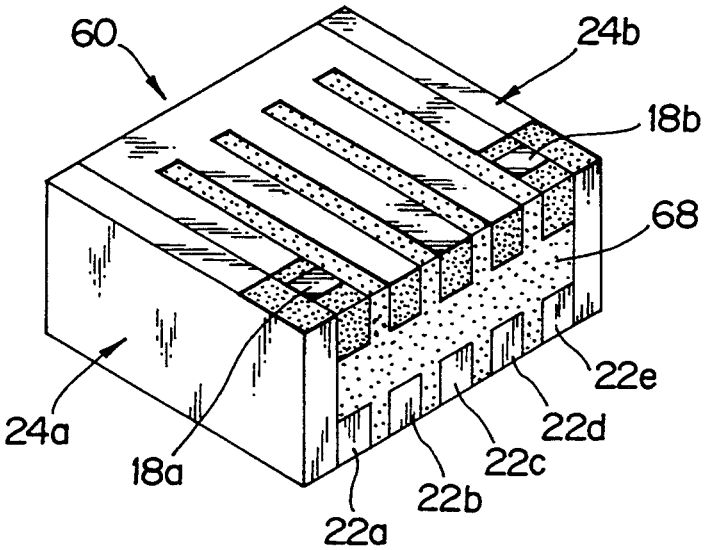
FIG. 18 is a perspective view of a modified example of the embodiment of FIG. 17, in which a cutout and slits are filled with separate dielectric members.

FIG. 18 shows another embodiment of the present invention. Since the basic construction of this embodiment is identical with that of the embodiment of FIG. 17, the corresponding parts are designated by the same reference numerals, and the descriptions thereof are omitted. In the embodiment of FIG. 18, the cutout and slits are filled with separated dielectric material 68. This dielectric material 68 may be identical with or different from that of the dielectric resonator block. This causes the Q-factor to increase and the mechanical strength to be improved as previously described. The resonator may be so formed that a separately-formed dielectric plate is inserted in the slits only. In such a case, openings or cutouts may be formed in the dielectric plate.

Each of the dielectric resonators which are separated from each other by the slits in the dielectric resonator blocks of FIGS. 17 and 18 is schematically identical with that of FIG. 1 the description of which was given first. Namely, the resonator shown in FIG. 1 is made by providing a cutout 12 in a dielectric plate 10 so that the plate 10 has a U-shaped body, and forming an electrode 16 on the outer circumferential surface (outer surface of the plate and inner surface of the cutout) thereof exclusive of the two primary surfaces thereof and one of two end surfaces of the cutout. Consequently, this structure can be regarded as a strip line type dielectric resonator which is formed by folding in two a $\frac{1}{4}$ wavelength resonator consisting of a long rod type dielectric with a U-shaped electrode formed on the outer surface thereof. This structure is miniaturized by utilizing a dielectric material effectively. In such a dielectric resonator, interstage coupling adjustment is carried out by varying the width of the coupling degree adjusting slits or the characteristics of the dielectric member fitted in the slits, whereby desired filter characteristics are obtained. In the case where dielectric plates each of which has an opening or a cutout therein are inserted in the slits, the degree of coupling between adjacent dielectric resonators is changed by adjusting the shape of the cutout or opening, whereby the filter characteristics are controlled.

Figure 19:
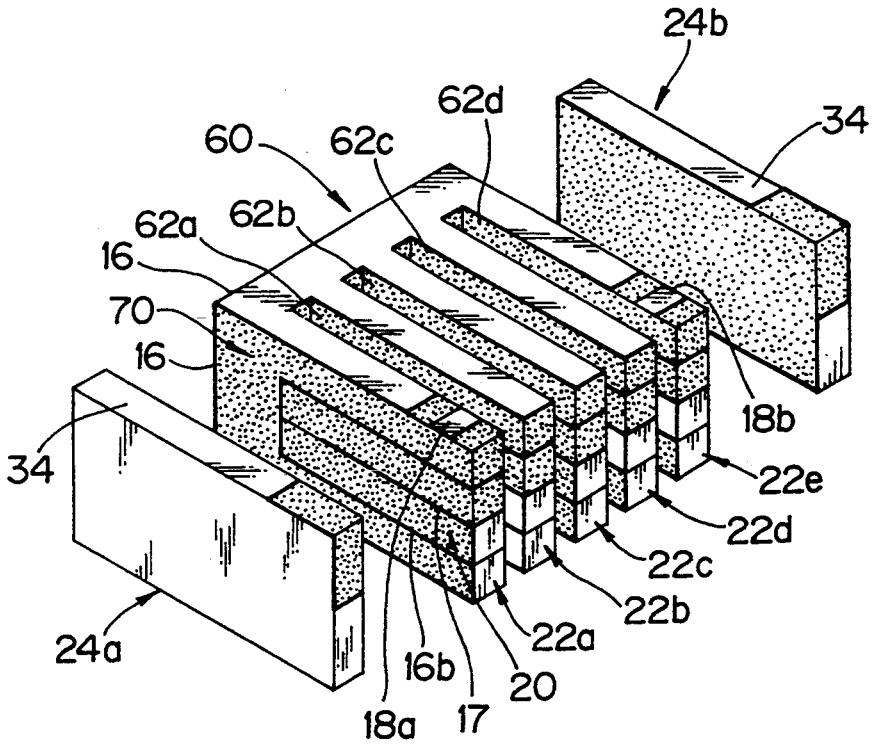
FIG. 19 is a perspective view of the unitary dielectric filter of still another embodiment of the invention, in which coupling degree adjusting slits are formed in four portions of a folded strip line type dielectric resonator block as to longitudinally divide the block into five dielectric resonators and connect them together.

FIG. 19 shows still another embodiment of a unitary dielectric filter. This is also a five-stage filter, the construction of which is basically identical with that of the embodiment of FIG. 17 described above, except the construction of the dielectric resonator. This dielectric filter is formed by making coupling degree adjusting slits 62*a*–62*b* in four portions of a folded strip line type dielectric block 60 so as to longitudinally divide the block into five connected dielectric resonators 22*a*–22*e*. The dielectric resonator block 60 is formed by providing U-shaped outer electrodes 16 on the outer circumferential surface of a cross-sectionally U-shaped outer dielectric block 70 exclusive of both end surfaces thereof, inserting inner dielectric blocks 20, each of which has a U-shaped intermediate electrode 16*b* and a central electrode 17 formed in the central porton thereof, in the inner portion (cutout) of the block 70, and joining the blocks 20 and the block 70 unitarily, the electrodes being short-circuited at one side only of each thereof on the outer circumferential surfaces of the dielectric blocks. The slits 62*a*–62*b* are so formed as to extend from the opened portion of the cutout to a position beyond the innermost portion of the cutout. Consequently, the dielectric resonators 22*a*–22*e* have structures which include folded strip lines formed three-dimensionally on the outer circumferential surfaces thereof, and which are connected together in the direction of the thickness thereof. One (non-electrode-carrying side) of the end surfaces of the opened portion of the cutout constitutes an opened side, and the other (electrode-carrying side) a short-circuited side, in the same manner as in the previously-described embodiment.

Outer dielectrics 24*a*, 24*b* are disposed on both ends of the dielectric resonator block 60 and bonded thereto unitarily. The outer dielectrics 24*a*, 24*b* are provided with electrodes 34 on their outer primary surfaces and outer circumferential portions (except a part of each thereof). The outer circumferential portions of the dielectric resonators 22*a* and 22*e*, positioned at both ends, which are close to the non-electrode-carrying end surfaces thereof have independent island electrodes 18*a*, 18*b*, which are used as input-output coupling electrodes. The portions of the outer dielectrics 24*a*, 24*b* which are close to the island electrodes 18*a*, 18*b* are non-electrode-carrying portions so that the electrode 34 is not electrically connected to the island electrodes 18*a*, 18*b*.

Each of the dielectric resonators which are separated from each other by slits in the dielectric resonator block of FIG. 19, is schematically identical with that of FIG. 8 the description of which was given previously. Namely, the resonator shown in FIG. 8 has a U-shaped resonator member consisting of a generally U-shaped dielectric substrate 10 in which a cutout is formed, and an electrode 16*a* formed on the outer circumferential portion of the substrate exclusive of both of the primary surfaces thereof and one of the parts of the outer circumferential portions thereof which are in the vicinity of both end surfaces thereof at an opened portion of the cutout. An inner resonator member consisting of dielectric pieces 20 is formed separately from the U-shaped substrate and has U-shaped electrodes 16*b* on the respective outer circumferential surfaces in such a way that the electrodes 16*b* are connected at one end only thereof to a central partial electrode 17. This inner resonator member is fitted in the cutout in the U-shaped resonator member with the non-electrode-carrying end surfaces thereof being flush with each other, and these resonator members are joined integrally. Consequently, this structure can be regarded as a strip line type dielectric resonator which is formed by folding in two a $\frac{1}{4}$ wavelength resonator consisting of a long rod type dielectric with a U-shaped electrode formed on the outer surface thereof, just like the previously described embodiment.

Figure 20:
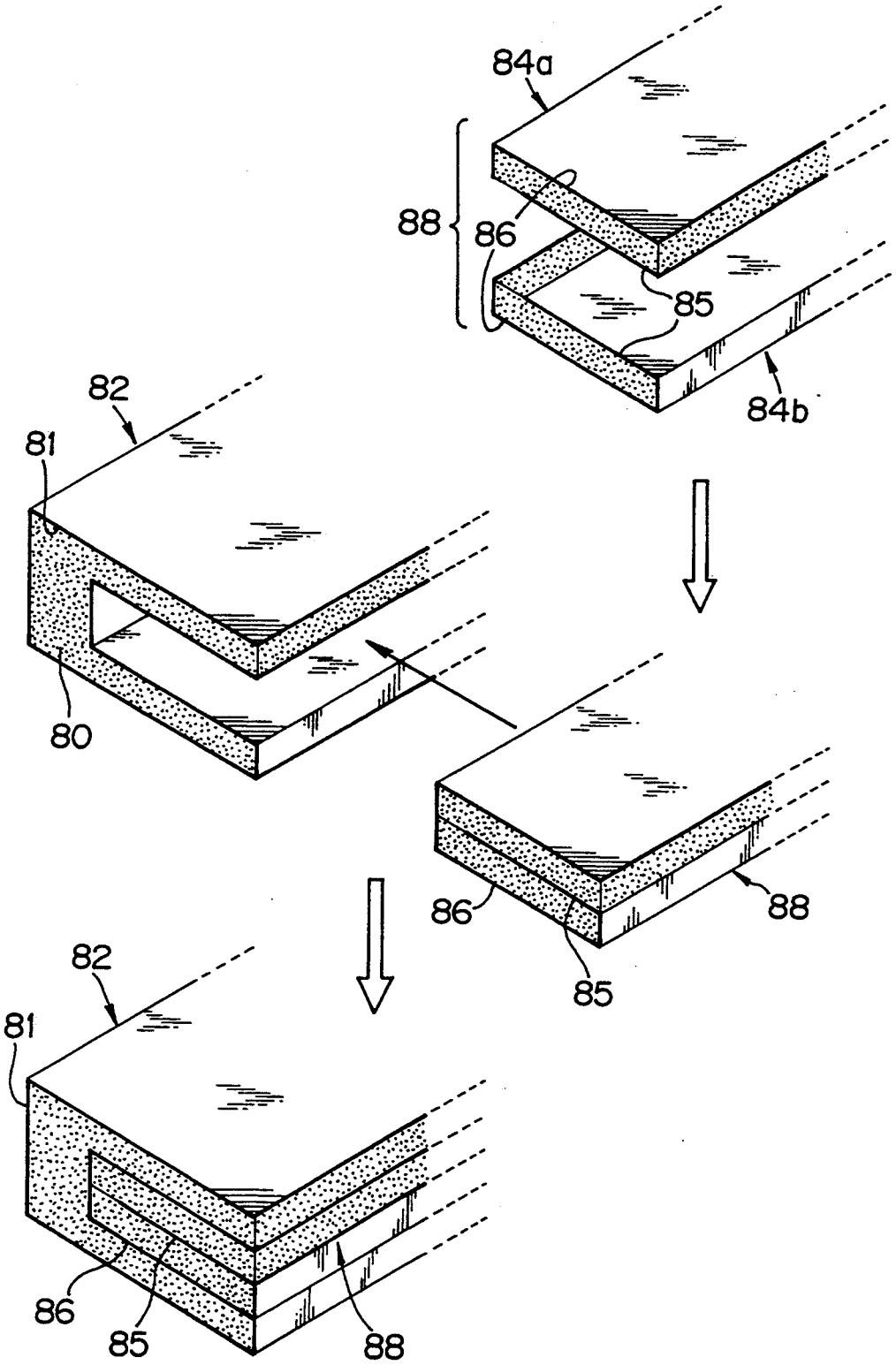
FIG. 20 illustrates the steps of manufacturing the dielectric filter of FIG. 19.

Such a dielectric resonator can be manufactured by, for example, the procedure illustrated in FIG. 20. First, a cross-sectionally U-shaped long block 80 made of a dielectric material is prepared. This block is formed by molding a cross-sectionally U-shaped long block and firing the molded product; or making a cutout in a long block of a sintered body; or joining a plurality of plate type or rod type or rod type long dielectric blocks to one another so as to obtain a cross-sectionally U-shaped product. After the long block 80 is prepared, a material for an electrode 81 is applied to predetermined areas and predetermined surfaces of the outer circumferential portion thereof, and the material is then fired, the whole being used as an outer dielectric block 82. Partial central electrodes 85 are formed on the mutually facing surfaces of two dielectric plates 84*a*, 84*b* of the same shape, and electrodes 86 are stuck to the outer side thereof. Thus an inner dielectric block 88, which has a U-shaped electrode 81, is formed. This inner dielectric block 88 is then fitted in the cutout in the outer dielectric resonator block 82 and joined unitarily. The resultant dielectric resonator is slitted at predetermined intervals and cut into pieces of predetermined lengths corresponding to the lengths of dielectric resonator blocks, whereby dielectric filters can be mass-produced easily.

Although the previously-described embodiments are directed to five-stage filters in which slits are formed in four portions thereof, it is obvious that the present invention can be applied to a dielectric filter of an arbitrary number of stages and more than two stages. In the case where a dielectric member is inserted in the slits, a film of a conductive material is formed on the end surface of the dielectric member so that the electrodes on adjacent dielectric resonator substrates are electrically connected together.

The preferred embodiments of the present invention have been described above but the present invention is not limited to these embodiments; it can be modified variously within the scope of the claims.

What is claimed is:

1. A folded strip line type dielectric resonator comprising:

a U-shaped dielectric substrate with a cutout formed in a part thereof, said U-shaped dielectric substrate having a top surface, a bottom surface and lateral side surfaces including at least two end surfaces, an electrode formed on said lateral side surfaces but not on said top and bottom surfaces and not on one of said at least two end surfaces in a vicinity of an opening to said cutout, and an independent island electrode, serving as an input-output coupling electrode, provided on one of said lateral side surfaces, separate from said electrode formed on said lateral side surfaces, and near said one of said at least two end surfaces in the vicinity of said opening to said cutout.

2. A resonator according to claim 1, wherein said cutout formed in the part of said dielectric substrate is undulated.

3. A resonator according to claim 1, wherein a separate dielectric member is fitted in said cutout formed in the part of said dielectric substrate.

4. A resonator according to claim 1, and further comprising separate dielectric substrates bonded to each of the top and bottom surfaces of said U-shaped dielectric substrate so as to form a three-layer sandwich structure, each of said separate dielectric substrates having an earth electrode on outer circumferential portions thereof except near said island electrode.

5. A dielectric resonator comprising:

a U-shaped dielectric substrate having a cutout formed therein and two primary surfaces, a U-shaped outer electrode formed on an outer circumferential surface of said substrate exclusive of the two primary surfaces, a U-shaped intermediate electrode formed on an inner surface of said substrate defined by said cutout, a pair of dielectric pieces received within said cutout, and a central electrode formed between said dielectric pieces, each of said intermediate and central electrodes being short-circuited at one of its ends with the U-shaped outer electrode.

6. A folded strip line type dielectric resonator comprising:

a U-shaped resonator member having a U-shaped dielectric substrate in a part of which a cutout is formed, said substrate having two primary surfaces, lateral side surfaces and two end surfaces, an electrode formed on said dielectric substrate exclusive of said two primary surfaces of said dielectric substrate and one of said two end surfaces of the dielectric substrate near an opened portion of said cutout, and an inner resonator member comprising dielectric pieces formed separately, having intermediate electrodes on respective outer surfaces, and a central electrode provided between the dielectric pieces so that said intermediate electrodes are connected to said central electrode, said inner resonator member being fitted in said cutout and having an end surface with no electrode aligned with said one of said two end surfaces of said dielectric substrate, said U-shaped and inner resonator members being joined together.

7. A dielectric resonator according to claim 5, wherein said dielectric substrate has an end surface with no electrode and is provided with an independent island electrode on the outer circumferential surface, separate from the U-shaped outer electrode, which is near the end surface with no electrode, said independent island electrode being used as an input-output electrode, and further comprising separate dielectric substrates boned to each of the two primary surfaces of the dielectric substrate so as to form a three-layer sandwich structure, each of said separate dielectric substrates being provided with an earth electrode on its outer primary surface and its outer circumferential portions except near said independent island electrode.

8. A dielectric resonator according to claim 6, and further comprising an independent island electrode, separate from said electrode formed on said dielectric substrate, on one of said lateral side surfaces near said one of said two end surfaces, said island electrode being an input-output coupling electrode, and separate dielectric substrates bonded to each of the two primary surfaces of said dielectric substrate so as to form a three-layer sandwich structure, said separate dielectric substrates each having an earth electrode on one of its primary surfaces and its outer circumferential portions except near said island electrode.

9. A multilayer dielectric filter comprising:

a plurality of dielectric resonator substrates, each of which has two end surfaces, primary surfaces and lateral surfaces, each of said dielectric substrates further having an outer electrode provided on its lateral surfaces but not on its primary surfaces, coupling degree adjusting dielectric substrates sandwiched between adjacent resonator substrates, outer dielectric substrates disposed on outer primary surfaces of outermost ones of said dielectric resonator substrates, said resonator substrates being positioned on both sides of each of said coupling degree adjusting dielectric substrates, said resonator substrates and said coupling degree adjusting dielectric substrates being joined together as a unit, wherein each of said coupling degree adjusting dielectric substrates has an electrode on outer circumferential portions thereof, each of said outer dielectric substrates has an electrode on an outer primary surface thereof and an outer circumferential portion thereof, and those dielectric resonator substrates of said dielectric resonator substrates which are positioned adjacent to said outer dielectric substrates having independent island electrodes on portions of the lateral surfaces thereof so that said island electrodes are used as input-output coupling electrodes.

10. A dielectric filter according to claim 9, wherein each of said dielectric resonator substrates has a cutout so that it is U-shaped, and said electrode provided on the lateral surfaces but not on the primary surfaces is also not provided on one of said two end surfaces of each of said dielectric resonator substrates near an open portion of said cutout.

11. A dielectric filter according to claim 9, and further comprising pairs of dielectric pieces, wherein each of said dielectric resonator substrates has a cutout so that it is U-shaped, each of said dielectric resonator substrates further includes a U-shaped intermediate electrode formed on surfaces defined by said cutout and a central electrode formed between dielectric pieces of each of said pairs of dielectric pieces, and each of said intermediate and central electrodes is short-circuited at one end thereof to the outer electrode.

12. A dielectric filter according to claim 9, wherein each of said coupling degree adjusting dielectric substrates has an opening therein.

13. A unitarized dielectric filter comprising:

a U-shaped dielectric block having a base portion and leg portions, an electrode formed on an outer circumferential portion of said dielectric block but not on end surfaces of said dielectric block to form a dielectric resonator block, coupling degree adjusting slits in said leg portions of said dielectric resonator block and dividing said block into a plurality of dielectric resonators, and independent island electrodes formed on outer circumferential portions of said dielectric resonators and positioned on the leg portions at both ends of said block so that said island electrodes are used as input-output coupling electrodes.

14. A dielectric filter according to claim 13, and further comprising outer dielectrics disposed on both sides of said dielectric resonator block and combined therewith as a unit, each of said outer dielectrics having an electrode on an outer primary surface and an outer circumferential portion thereof.

15. A dielectric filter according to claim 14, wherein said dielectric block has a cutout in one side surface extending in a longitudinal direction thereof to define said base portion and said leg portions, and said electrode is formed on said outer circumferential portion but not on said end surfaces near an opening of said cutout.

16. A dielectric filter according to claim 14, wherein said electrode formed on said outer circumferential portion of said dielectric block is an outer U-shaped electrode, and further comprising an inner dielectric block, having a U-shaped intermediate electrode on its outer surface and a central electrode formed in its central portion, provided in a cutout defined between said leg portions of said dielectric block, said intermediate and central electrodes being short-circuited to the outer U-shaped electrode.

17. A dielectric filter according to claim 13, wherein said slits have a coupling degree adjusting dielectric filled therein.

* * * * *